US008242933B2

(12) United States Patent
Pashel

(10) Patent No.: US 8,242,933 B2
(45) Date of Patent: Aug. 14, 2012

(54) WIRELESS TRAFFIC LIGHT CONTROLLER

(75) Inventor: Nicholas Pashel, Pittsburgh, PA (US)

(73) Assignee: Ibis Tek, LLC, Butler, PA (US)

( * ) Notice: Subject to any disclaimer, the term of this patent is extended or adjusted under 35 U.S.C. 154(b) by 596 days.

(21) Appl. No.: 12/505,485

(22) Filed: Jul. 18, 2009

(65) Prior Publication Data

US 2011/0012757 A1 Jan. 20, 2011

(51) Int. Cl.
*G08G 1/07* (2006.01)

(52) U.S. Cl. ..... 340/906; 340/908; 340/916

(58) Field of Classification Search ..... 340/906, 340/907, 908, 909, 916, 924
See application file for complete search history.

(56) References Cited

U.S. PATENT DOCUMENTS

| | | | | |
|---|---|---|---|---|
| 3,015,802 | A | 4/1953 | Newsom | |
| 2,829,362 | A | 5/1954 | Terrill | |
| 3,159,817 | A | 9/1959 | Hendricks et al. | |
| 3,247,482 | A | 5/1961 | Lesher | |
| 3,168,685 | A | 4/1962 | Beet | |
| 3,867,718 | A | 2/1975 | Moe | |
| 4,135,144 | A * | 1/1979 | Elmasian | 340/906 |
| 4,162,477 | A | 7/1979 | Munkberg | |
| 4,401,969 | A | 8/1983 | Green et al. | |
| 4,857,921 | A | 8/1989 | McBride et al. | |
| 5,959,554 | A | 9/1999 | Armstrong et al. | |
| 6,118,388 | A | 9/2000 | Morrison | |
| 6,133,854 | A * | 10/2000 | Yee et al. | 340/907 |
| 6,724,320 | B2 * | 4/2004 | Basson et al. | 340/906 |
| 7,733,242 | B2 | 6/2010 | Bertels | |
| 2006/0197683 | A1 | 9/2006 | Hammett | |

OTHER PUBLICATIONS

New LED Traffic Signals from Lights to Go, website: http://www.trafficlights.com/LEDsigs.htm#JD200/RC3: printed Mar. 11, 2009: 7 pages.

* cited by examiner

*Primary Examiner* — Toan N Pham
(74) *Attorney, Agent, or Firm* — Karen Tang-Wai Sodini

(57) ABSTRACT

A one-person remote control system for overriding pre-established control sequences of a traffic light, which control system is compatible with plug-in communications connectors conventionally provided with traffic light controllers. The remote control system comprises a stationary signal transfer unit which has a signal receiver and a plug-in connector for communicating with the traffic light controller, and a mobile control unit disposed to receive manual commands from the person providing overriding control, and a transmitter for transmitting manual overriding command signals to the stationary signal transfer unit.

20 Claims, 6 Drawing Sheets

| TABLE | |
|---|---|
| Part # | |
| A | Roadway |
| B | Roadway |
| C | Traffic light |
| D | Traffic light controller |
| E | Housing |
| F | Green traffic light |
| G | Green traffic light |
| H | Red traffic light |
| I | Red traffic light |
| J | Police officer |
| 100 | Control arrangement |
| 120 | Control unit |
| 140 | Antenna |
| 160 | Command signals |
| 180 | Signal transfer unit |
| 200 | Antenna |
| 220 | Cable |
| 240 | Circuitry |
| 260 | Pushbutton |
| 280 | Transmitter |

Fig. 7A

| TABLE | |
|---|---|
| Part # | |
| 320 | Battery |
| 340 | Battery charger |
| 360 | Battery condition indicator |
| 380 | Receiver |
| 400 | Annunciator lamp |
| 420 | Buzzer |
| 440 | Vibrator |
| 460 | Logic center |
| 480 | Battery |
| 500 | Battery charger |
| 520 | Battery condition indicator |
| 540 | Circuitry |
| 560 | Hard wired connection |
| 580 | Removable connector |
| 600 | Main power switch |
| 620 | Three position selector switch |
| 660 | Radio frequency receiver |
| 700 | Transmitter |
| 720 | Housing |
| 740 | Input power port |
| 760 | Output power port |
| 780 | Input power port |
| 800 | Housing |
| 820 | Two position switch |
| 840 | Display |
| 860 | Cable |
| 880 | Cable connector |
| 900 | Signal port |

Fig. 7B

WIRELESS TRAFFIC LIGHT CONTROLLER

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Traffic lights are typically automatically controlled under repeating timing cycles for each light. Municipal authorities usually determine ordinary, predictable traffic volume, and adjust light length cycles accordingly. It is occasionally necessary for police officers and other municipal authorities to override and modify automated traffic light control sequences. A temporary activity which changes the usual traffic patterns is typically a cause for such necessity. A sports or theatrical event at a church or school, a collision between two vehicles, and displacement of traffic from other roads are some examples of temporary activities which could cause delays and backups at a particular intersection which is controlled by a traffic light which is under automatic control.

If an automated traffic light controller is to be modified, this ordinarily becomes a two-person operation. One of the two must be located proximate the traffic light controller or control box, which is typically located proximate the roadway or intersection being controlled. Manufacturers of traffic lights and their controllers have anticipated this need, and have provided a plug-in connection in the control box for entering commands which override the automated sequences. Commands may be entered by a hand held controller which may be a pushbutton controller or other manually operated device. The hand held controller has a cord and terminal which provides a hard wired or continuous mechanical and electrical communications line to the control box. The manually entered commands cause the controller to implement the next phase of the pre-established automated sequence. However, such commands are not remembered, so that the person entering these commands must remain with the controller and continue to enter commands as long as he or she wishes to override the automated sequences.

While this enables manual overriding control of the traffic light, it nonetheless has adverse consequences. One is that the police officer or other personnel controlling the traffic light is located at a vantage point which is usually far from optimal in observing traffic conditions. The second person is usually required to be located at a favorable vantage point for observing traffic, so as to determine when to change the traffic light control sequence. A second adverse consequence is that these two must communicate with one another to assure efficient and appropriate management of the traffic light. This communication can be cumbersome and subject to misunderstandings, and still does not address the problem of tying up two people to manage a traffic light.

Remote traffic controllers which enable one person to manage a traffic light from a location remote from the control box are known. However, traffic light boxes, as ordinarily supplied and installed, do not have means for communicating remotely. Rather, each has a plug-in terminal for receiving the known prior art hand held controller. Apparatus enabling remote communication could be provided at existing traffic light controllers, but this entails great additional expense in that every traffic light controller must then be furnished with a suitable interface device. This solution, while technically feasible, would impose significant and objectionable costs to the municipality operating those traffic lights.

There remains a need for a traffic light controller which reduces the demand for personnel in temporarily overriding automated traffic light control, and which does not impose undue costs of modification to existing traffic light controllers.

SUMMARY OF THE INVENTION

The present invention addresses the above need by providing a remotely operated controller which both allows one person to manage a traffic light, and which cooperates with existing plug-in connection of traffic light controllers.

The novel remotely operated controller comprises two separate components, including a first component which is maintained by the person managing the traffic light, and a second component which receives remote signals from the first component, and which uses the conventional plug-in connection to transmit the signals to a conventional traffic light controller.

The system may utilize radio frequency signals, and may encode these signals to maintain integrity of the system. A confirmation signal may be generated by the plug-in component so that the operator is assured that requested commands have been received and will be implemented.

The system may incorporate a "learn" mode in which a desired sequence is formulated and programmed into the system, and an "operate" mode in which the traffic light is automatically controlled under the temporary overriding scheme.

BRIEF DESCRIPTION OF THE DRAWINGS

FIGS. 7A and 7B collectively show a table of reference numerals used and their subject matter.

Similar reference characters denote corresponding features consistently throughout the attached drawings.

DETAILED DESCRIPTION OF THE PREFERRED EMBODIMENTS

The present invention is directed to a control arrangement for overriding automated control of a traffic light having a pre-existing mechanical connector located at a control box, for receiving a temporary controller so that overriding command signals may be manually entered. More specifically, the present invention contemplates a wireless remote link so that a communications device may be plugged into the system at the control box while being controlled by one person who may be remotely located from the control box.

Figure 1:
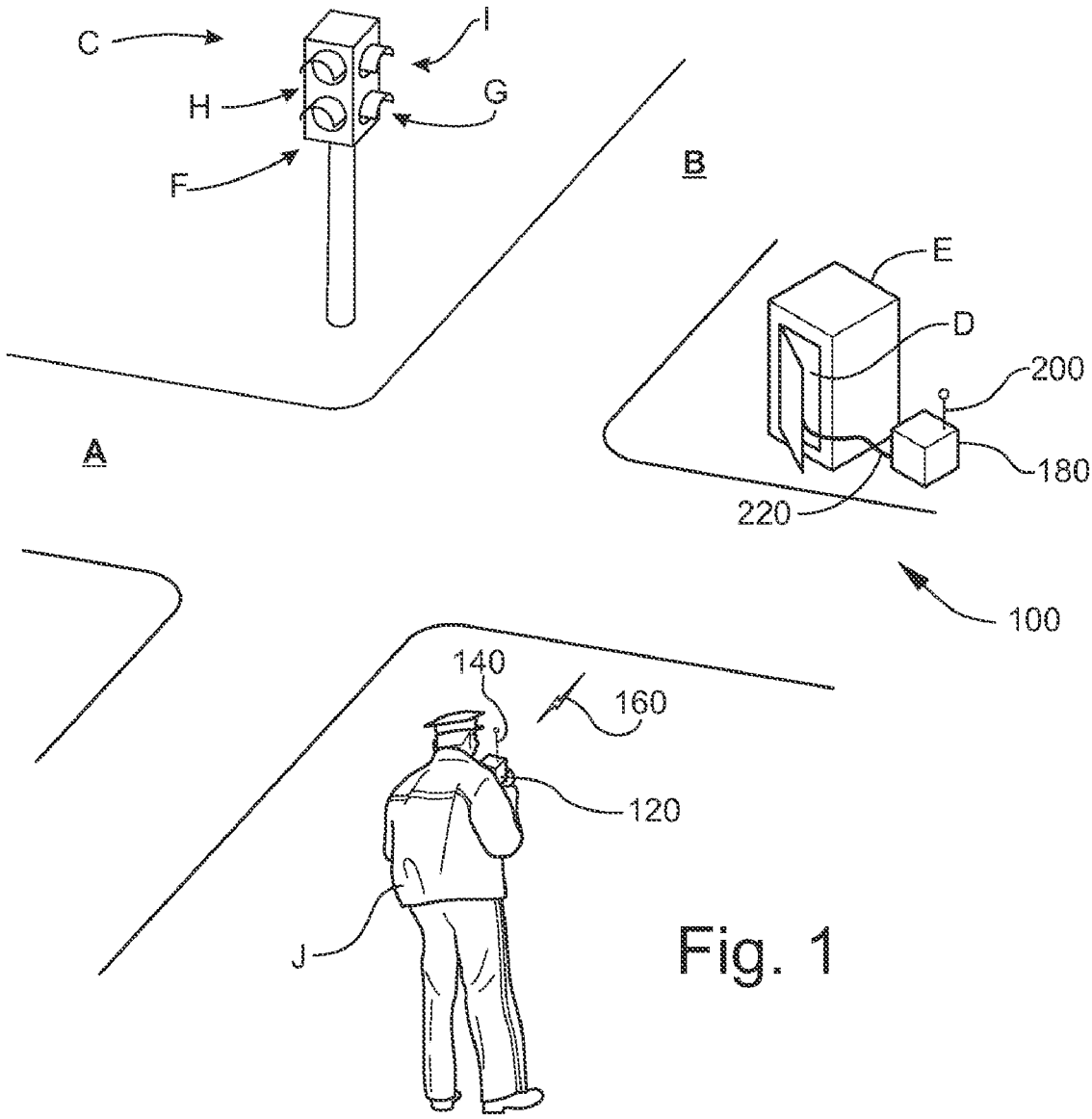
FIG. 1 is a diagrammatic environmental view of a control arrangement as it might be employed according to at least one aspect of the invention.

Referring first to FIG. 1, there is shown an intersection of two roadways A and B, which intersection is controlled by a traffic light C. Ordinarily, the traffic light C is under automated, fixed, repeating cycling control of a traffic light controller D which is housed in a weather resistant housing E located remotely from the traffic light C. The traffic light controller D has circuitry which establishes timing cycles of the various directional control lights (such as green lights F, G and red lights H, I) of the traffic light C.

In the event that temporary traffic conditions render the usual time cycling of the lights F, G, H, I inappropriate, a representative of the municipal authority which operates the traffic light C, such as a police officer J, may take modify operation of the traffic light C using a control arrangement 100 in the following way.

The police officer J who is charged with assuming control of the traffic light C may maintain in his possession and control a control unit 120 which may comprise electrical circuitry which is disposed to generate control commands which supersede those which have been preprogrammed or otherwise installed in the traffic light controller D. The electrical circuitry of the control unit 120 may be provided with the ability to generate control commands and to transmit these control commands remotely. Illustratively, the control unit 120 may incorporate a radio frequency transmitter (represented by an antenna 140, with control command signals being indicated symbolically as 160).

The control unit 120 cooperates with a stationary signal transfer unit 180 which may have electrical circuitry comprising a radio frequency receiver (shown symbolically as an antenna 200) for receiving the command signals 160. The stationary signal transfer unit 180 transfers the control commands 160 to the traffic light controller D by a hard wired connection comprising and represented by a cable 220. The cable 220 terminates in a removable connector (not separately shown) which mechanically plugs into or otherwise connects to, and is matingly compatible with, a pre-existing mechanical connector or port (not shown) which is conventionally furnished as part of the traffic light controller D), and which accepts a plug in type connector of a hand held device (not shown) which is conventionally used to enter manual command signal to override the sequences established by the traffic light controller D. Whereas the conventional overriding manual signals can only be generated by a person located near the traffic light controller D, and each manual signal must be followed by a subsequent manual signal, the novel arrangement 100 both enables remote generation of overriding command signals, and further may also enable sequences of command signals to be entered into memory and automatically implemented.

Figure 2:
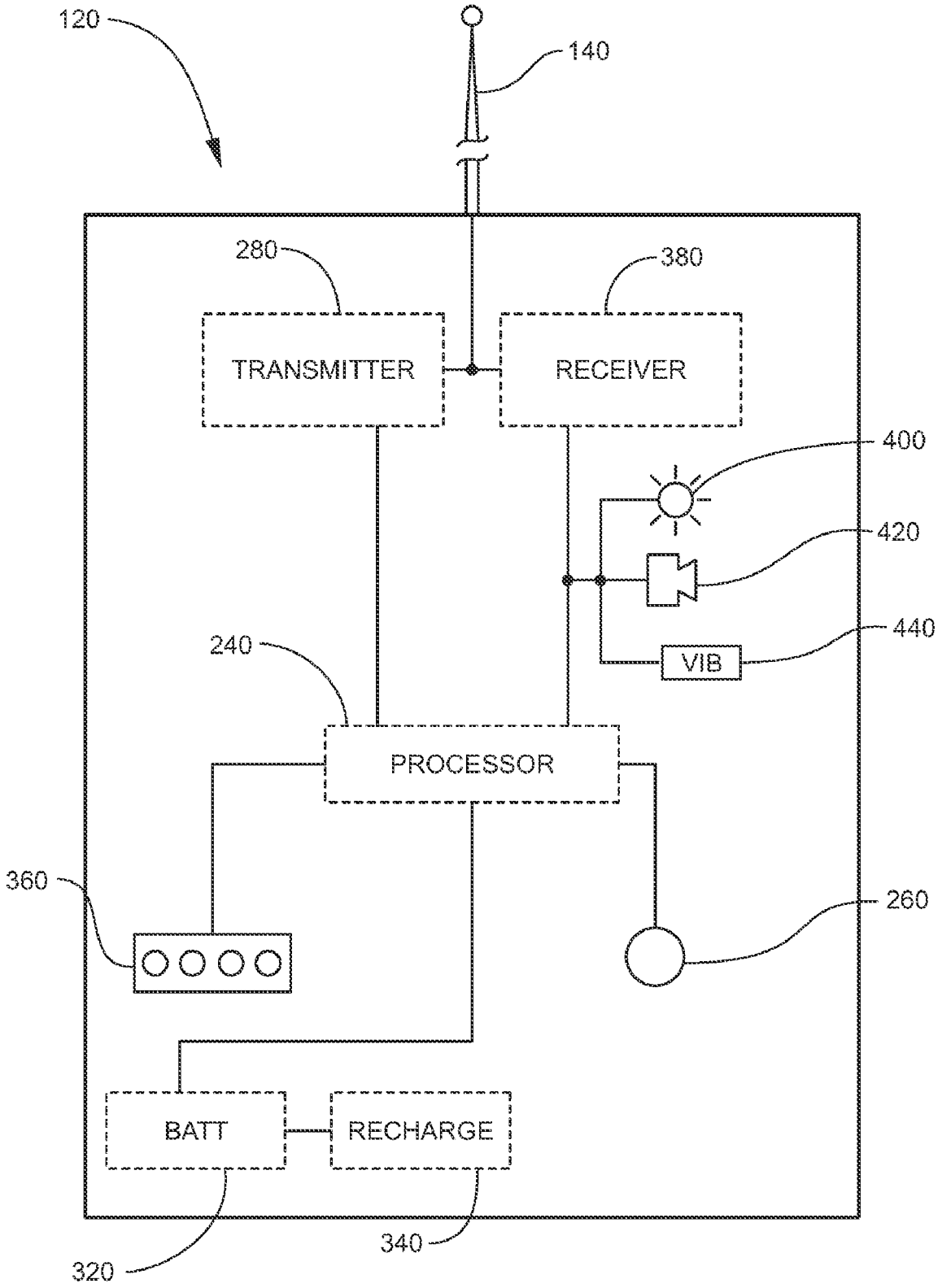
FIG. 2 is a diagrammatic representation of functional components of a portable control unit shown at the bottom of FIG. 1.

FIG. 2 shows an exemplary mobile control unit 120. The control unit 120 is mobile in the sense that it can be carried about as the operator, e.g., police officer J, moves to different locations at the intersection or traffic light C which is under overriding control. By contrast, although the stationary signal transfer unit 180 is movable within the limits of the length of the cable 220, it is not capable of being moved across the street while remaining connected to the traffic controller E.

The control unit 120 may comprise processor circuitry 240, which may take any of several forms. It may for example comprise electromechanical relays and be essentially hard wired. Alternatively, it may comprise electronic data processing apparatus. Of course, it may comprise a combination of these elements. The processor circuitry 240 is shown only representatively, and will be understood to comprise all components necessary for operation as described herein, such as conductors, connection logic, relays, switches, etc. This will apply to circuitry in the signal transfer unit 180 as well.

Regardless of its exact implementation, the processor circuitry 240 is adapted to receive inputs and to generate appropriate outputs. One input is signals generated when the police officer J depresses a momentary contact pushbutton 260. The processor circuitry 240 may responsively transmit a signal to the signal transfer unit 180, using a transmitter 280 and the antenna 140. The signal may be transmitted by the transfer unit 180 to the traffic controller E (see FIG. 1). Each signal may for example cause the traffic controller to advance to the next traffic light function. The control unit 120 may further comprise a power source such as a battery 320, a battery charger 340 which may incorporate a fast charge feature and other contemporary technology to result in effective, non-destructive charging, such as eliminating or minimizing overcharging for example, and a battery condition indicator 360 which may for example display voltage level or other electrical characteristics of the battery 320. Although depicted as showing a series of individual lamps which may for example be progressively illuminated to indicate state of charge, the battery condition indicator 360 may take any suitable form.

It may be noted here that the control unit 120 may have signal receiving capability, such as by incorporating a radio frequency receiver 380 which is connected to the antenna 140. One possible use of the receiver 380 is to receive signals confirming receipt of command signals from the control unit 120 to the signal transfer unit 180. Receipt of confirmation signals may be signaled in any suitable way, such as by operating an annunciator lamp 400 for generating a visible signal, an audible annunciator such as a buzzer 420 for generating an audible signal, or an annunciator vibrator 440 for generating a tactile or vibrating signal.

Figure 3:
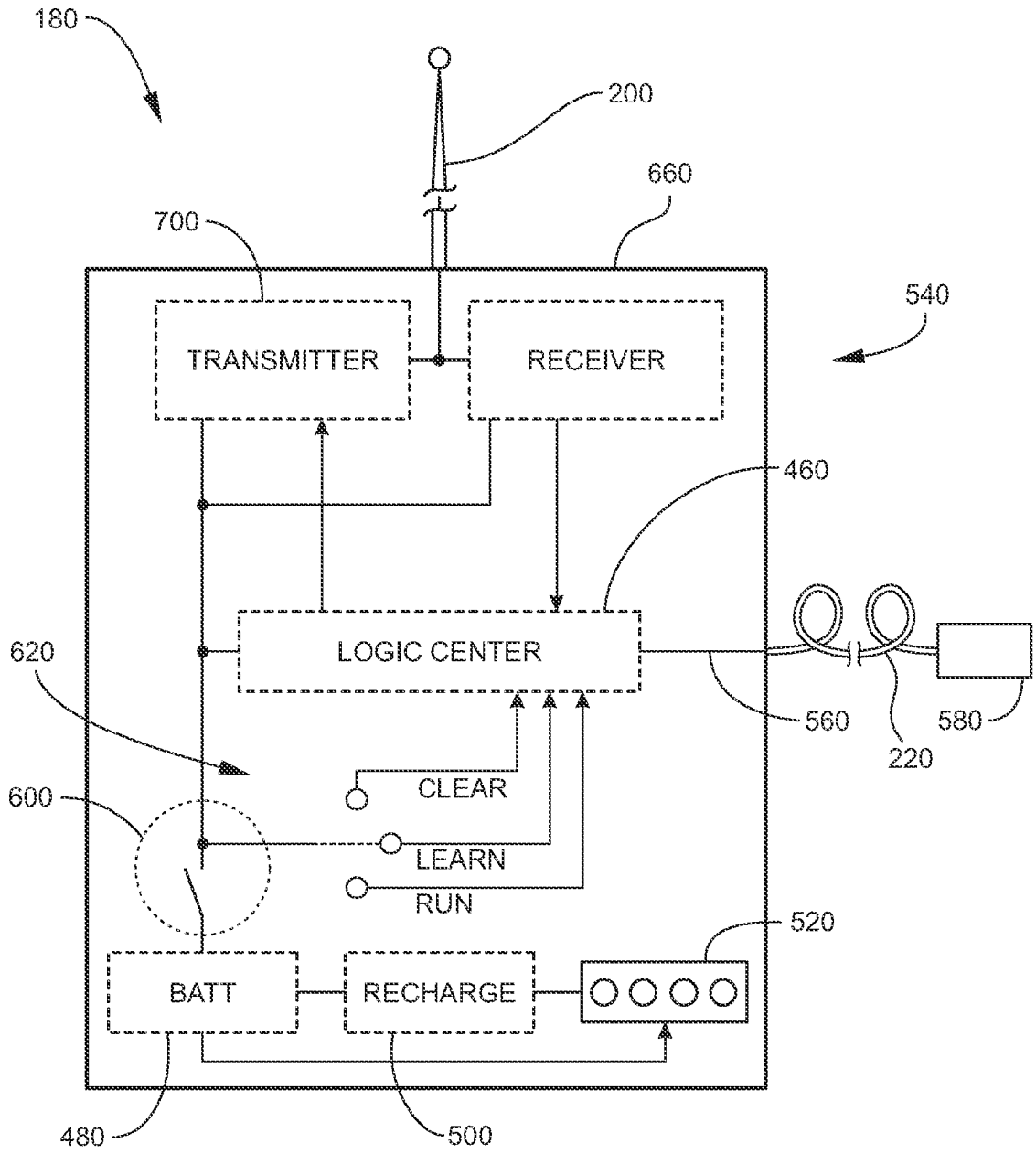
FIG. 3 is a diagrammatic representation of functional components of a stationary signal transfer unit shown at the upper right of FIG. 1.

Turning now to FIG. 3, the signal transfer unit 180 is seen to comprise a logic center 460. The logic center 460 is preferably a data processing device, although it could utilize hard wiring such as that incorporating electromechanical relays in whole or in part if desired.

The signal transfer unit 180 is so called for semantic convenience only, having other functions as well. The signal transfer unit 180 may comprise a battery 480, a battery charger 500, and a battery condition indicator 520, all of which may be similar to their correspondingly named counterparts of the control unit 120.

The various electrical components of the signal transfer unit 180 described above are interconnected by electrical circuitry 540. The electrical circuitry further comprises a hard wired connection 560 disposed to transmit control signals received from the control unit 120 to the traffic light controller D (see FIG. 1). The hard wired connection 560 may comprise a removable connector 580 which is dimensioned, configured, and otherwise disposed to mechanically connect to the pre-existing mechanical connector (not shown) of the traffic light controller D. Usually, mechanical connection comprises plugging the removable connector 580 to a socket (not shown) located at an accessible surface of a component of the traffic light controller D. The removable connector 580 may terminate the cable 220, which may comprise a coiled, flexible, elastically extensible cable.

The electrical circuitry 540 may comprise a main power switch 600 and a three position selector switch 620. The main power switch 600 controls power to all electrical components of the signal transfer unit 180. The three position selector switch 620 is arranged to send a power signal to the logic center 460 to selectively operate in any one of three modes.

When the signal transfer unit 180 is first connected to the traffic light controller D, it is typically not preprogrammed with a traffic light operating cycle scheme which is suitable or appropriate for the temporary conditions requiring overriding control. Therefore, the three position selector switch 620 may be moved to a "learn" position wherein operating time intervals for each light of the traffic light C may be entered and adjusted if necessary. In the "learn" mode, each traffic control signal, and hence duration of illumination of each of the lights such as the lights F, G, H, and I (see FIG. 1), must be manually entered. The entered time interval of operation will then prevail until a timing function for a subsequent light operation interval is manually entered. A new operating scheme of entered signals is entered into the memory of the system and will operate in a "run" mode under automated, repeating cycles. The "run" mode is initiated by moving the three position selector switch 620 to the run position. In summary, the new overriding control sequencing is established in the learn mode, and is implemented in the run mode, where these modes correspond to positions of the three position selector switch 620. Although the established sequence may be retained, it is further possible to erase the established sequence by moving the three position selector switch 620 to the "clear" position, which action clears the memory of the learned sequence. It should be understood that as employed relative to the sequence of traffic light operating intervals, memory may be that of a timing relay, electronic memory of a data processing device, a mechanical memory device such as a spring or pneumatic memory device (not shown), or any other suitable arrangement for accomplishing the performance described herein.

It would be possible to use an automated mode of operation which would cause a timing cycle to pause at a particular point until reactivated by for example, depressing a control on a remote controller such as the 120. Upon releasing the pause feature, the previously established cycles could resume.

Command signals for operating the signal transfer unit 180 may be obtained through the antenna 200 and a radio frequency receiver 660. The logic center 460 may be disposed to recognize receipt of the control signals and to generate a confirmation signal indicative of receipt of the control signals. The confirmation signal may be transmitted by a transmitter 700 and the antenna 640. Receipt of these confirmation signals may be annunciated by any of the annunciator lamp 400, the buzzer 420 or the annunciator vibrator 440 of the control unit 120.

The control unit 120 may comprise known apparatus for implementing an encoding feature for encoding overriding command or control signals transmitted from the control unit 120, so that the overriding control signals are secured against unauthorized modification, distortion from electromagnetic interference, and other deleterious influences.

Figure 4:
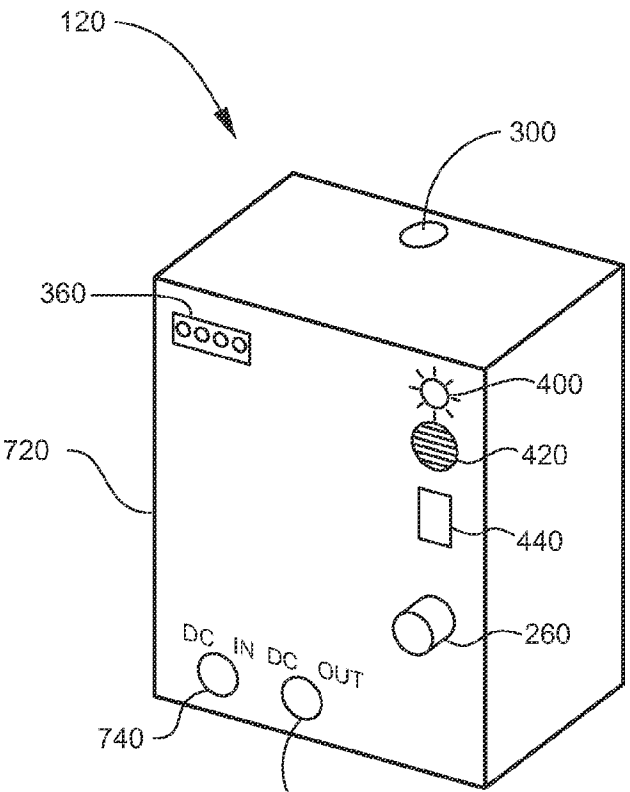
FIG. 4 is a perspective view of an implementation of the component of FIG. 2.

FIG. 4 shows how an enclosure or housing 720 of the control unit 120 may appear. The housing 720 may have an input power port 740 and an electrically connected output power port 760. This enables an operator to charge both the control unit 120 and the signal transfer unit 180 simultaneously by connecting power to the input power port 740 and electrically connecting a jumper cable (not shown) between the output power port 760 and a corresponding input power port 780 located in the enclosure or housing 800 of the signal transfer unit 180 (see FIG. 5). The annunciator lamp 400, the buzzer 420, the annunciator vibrator 440, the pushbutton 260, and the battery condition indicator 360 may be mounted on the housing 720, which, together with its externally exposed components, may be water resistant. The antenna 140 may project through the housing 720.

Figure 5:
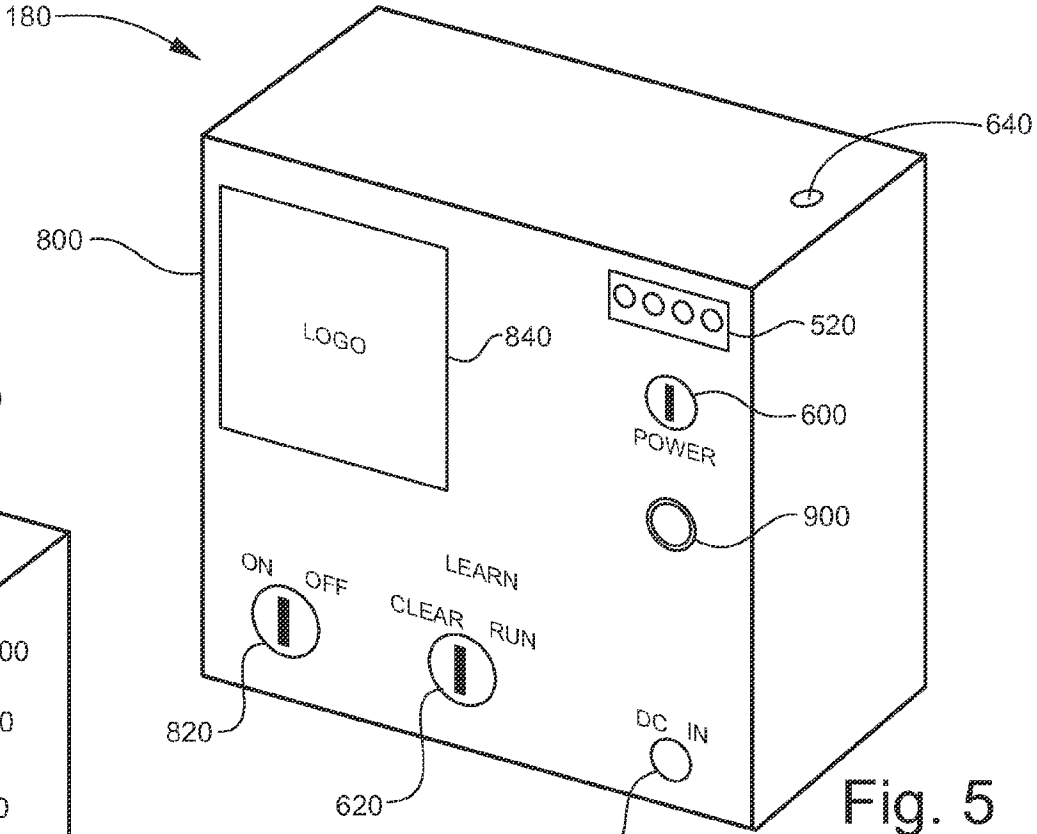
FIG. 5 is a perspective view of an implementation of the component of FIG. 3.

Referring to FIG. 5, the housing 800 may have the battery condition indicator 520, the main power switch 600, the three position selector switch 620, the input power port 780, and a two position switch 820 mounted thereon. The housing 800 and its externally exposed components may be water resistant.

The three position selector switch 620 and the two position switch 820 may be key operated switches, as may the main power switch 600. The two position switch 820 may set timing intervals to be employed in the learn mode, wherein each timing interval corresponds to duration of a specific traffic light function. The two position switch 820 may be utilized in conjunction with the three position selector switch 620 when the latter is in the learn mode position.

The housing 800 may comprise a frame or display 840 for displaying identity of the municipal authority operating the novel control arrangement. The display 840 may comprise a pocket having a transparent or translucent window, a permanently formed insignia representing a municipal authority such as a police department, or any other suitable symbol or arrangement which will enable passersby and other observers to discern the identity of the operator of the novel control arrangement, and thus be reassured that the system is being operated by proper authorities.

Figure 6:
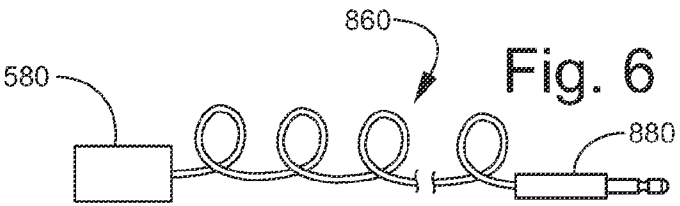
FIG. 6 is a side elevational view of a cable shown at the upper right of FIG. 1.

FIG. 6 shows a cable 860 which may be used in conjunction with the removable connector 580 which plugs into the signal port of the traffic controller E (see FIG. 1). The cable 860 may be part of the hard wired connection 560 (see FIG. 3) between the signal transfer unit 180 and the signal port of the traffic controller E. The cable 860 may comprise a breakaway connector further comprising a manually separable cable connector 880, for example, having frictional engagement characteristics such that pulling on the signal transfer unit 180 when the hard wired connection 560 is plugged into the traffic light controller E will cause the breakaway connector to separate before tension imposed by pulling causes damage to the hard wired connection 560. The cable connector 880 may plug into a signal port 900 located in the housing 800 of the signal transfer unit 180. The cable connector 880 may be for example, of the type popularly used with audiovisual equipment such as stereos and like consumer electronic equipment (none shown). The cable 860 may be water resistant.

The present invention is susceptible to variations and modifications which may be introduced thereto without departing from the inventive concepts.

Location of processing apparatus, software, and other supervisory capabilities, switches, and command entry interface components may be exchanged between or even redundantly furnished as part of the control unit 120 and the stationary signal transfer unit 180.

Although the stationary signal transfer unit 180 has been described in terms of containing processor capability such that certain control functions are performed therein, it is contemplated that the control unit 120 could be modified to accommodate the same functions. Illustratively, the learn function could be satisfied from a location away from the traffic controller E.

Either or both of the control unit 120 and the stationary signal transfer unit 180 may be modified for reception of signals from still other sources, such as a central control station for controlling traffic lights, such as a municipal traffic control center (not shown), and to transmit signals, such as status signals, to remote stations, such as the municipal traffic control center (not shown) which is remote from the intersection or traffic light C which is under temporary overriding control.

The signal transfer unit 180 may comprise any one or any two of the annunciator lamp 400, the buzzer 420, or the vibrator 440, rather than all three as shown and described.

It is to be understood that the present invention is not limited to the embodiments described above, but encompasses any and all embodiments within the scope of the following claims.

I claim:

1. A control arrangement for overriding automated control of a traffic light having a pre-existing mechanical connector for receiving a temporary controller so that overriding command signals may be manually entered, comprising:

a control unit to be operated by a person charged with assuming control of the traffic light, said control unit comprising electrical circuitry disposed to generate control commands and to transmit said control commands remotely; and a stationary signal transfer unit having electrically circuitry comprising a receiver disposed to receive said control signals from said control unit, wherein said circuitry comprises a hard wired connection disposed to transmit said control signals, said hard wired connection comprising a removable connector which is disposed to mechanically connect to the pre-existing mechanical connector of the traffic light.

2. The control arrangement according to claim 1, further comprising a data processing system comprising memory, wherein said data processing system is disposed to operate in a learn mode wherein each traffic control signal must be manually entered and will prevail until modified by a subsequent manually entered signal, and a run mode wherein the entered signals have been entered into said memory and operate under automated, repeating cycles.

3. The control arrangement according to claim 2, wherein the data processing system comprises a clear function which clears the memory of manually entered signals.

4. The control arrangement according to claim 3, wherein said stationary signal transfer unit comprises a first switch for setting timing intervals to be employed in said learn mode, wherein each timing interval corresponds to duration of a specific traffic light function, and a second switch for selecting among said learn mode, said run mode, and a reset mode which operates said clear function to clear said control arrangement of said automated, repeating cycles of said run mode.

5. The control arrangement according to claim 4, wherein said first switch and said second switch of said stationary signal transfer unit are key operated switches.

6. The control arrangement according to claim 1, wherein said stationary signal transfer unit further comprises a data processing system which is disposed to recognize receipt of said control signals and to generate a confirmation signal indicative of receipt of said control signals; and said control unit comprises a receiver disposed to receive said confirmation signal and an annunciator disposed to annunciate receipt of said confirmation signal.

7. The control arrangement according to claim 6, wherein said annunciator is disposed to generate an audible signal.

8. The control arrangement according to claim 6, wherein said annunciator is disposed to generate a visible signal.

9. The control arrangement according to claim 6, wherein said annunciator is disposed to generate a vibrating signal.

10. The control arrangement according to claim 1, further comprising apparatus for implementing an encoding feature for encoding said overriding control signals, whereby said overriding control signals are secured against unauthorized modification.

11. The control arrangement according to claim 1, wherein said stationary signal transfer unit has a water resistant enclosure.

12. The control arrangement according to claim 1, wherein said control unit has a water resistant enclosure.

13. The control arrangement according to claim 1, wherein said electrical circuitry of said stationary signal transfer unit comprises a rechargeable battery.

14. The control arrangement according to claim 13, wherein said electrical circuitry of said stationary signal transfer unit comprises a battery condition indicator.

15. The control arrangement according to claim 1, wherein said electrical circuitry of said control unit comprises a rechargeable battery.

16. The control arrangement according to claim 1, wherein said circuitry of said stationary signal transfer unit comprises a battery condition indicator.

17. The control arrangement according to claim 1, wherein said electrical circuitry of said control unit comprises a first input power port and an electrically connected output power port, and said electrical circuitry of said stationary signal transfer unit comprises a second input power port, whereby said battery of said stationary signal transfer unit may be charged from said control unit by connecting a jumper cable between said output power port of said control unit and said input power port of said stationary signal transfer unit.

18. The control arrangement according to claim 1, wherein said hard wired connection of said stationary signal transfer unit comprises at least one breakaway connector having a manually separable cable connector having frictional engagement characteristics such that pulling on said stationary signal transfer unit when said hard wired connection is plugged into the traffic light controller will cause the breakaway connector to separate before tension imposed by pulling causes damage to the hard wired connection.

19. The control arrangement according to claim 1, wherein said stationary signal transfer unit comprises a display for displaying identity of the municipal authority operating said control arrangement, whereby observers may discern the identity of the operator of said control arrangement and thus be reassured that the system is being operated by proper authorities.

20. The control arrangement according to claim 1, wherein said control unit comprises at least one momentary contact pushbutton operated switch for generating said command signals.

* * * * *